US007145091B1

(12) United States Patent
Wang

(10) Patent No.: US 7,145,091 B1
(45) Date of Patent: Dec. 5, 2006

(54) WATERPROOF AND DUSTPROOF SWITCH STRUCTURE

(75) Inventor: Pai-Shan Wang, Rondo Township, Tainan County (TW)

(73) Assignee: Shin Chin Indutrial Co., Ltd., Tainan Hsien (TW)

( * ) Notice: Subject to any disclaimer, the term of this patent is extended or adjusted under 35 U.S.C. 154(b) by 0 days.

(21) Appl. No.: 11/244,160

(22) Filed: Oct. 6, 2005

(51) Int. Cl.
*H01H 19/06* (2006.01)

(52) U.S. Cl. ..... 200/302.3; 200/302.1; 200/339; 200/315

(58) Field of Classification Search .. 200/302.1–302.3, 200/339, 310–315
See application file for complete search history.

(56) References Cited

U.S. PATENT DOCUMENTS 4,191,873 A * 3/1980 Woodard ..... 200/302.3
5,990,431 A * 11/1999 Wright ..... 200/302.3
6,103,982 A * 8/2000 Chien ..... 200/315
6,573,466 B1 * 6/2003 Rapp et al. ..... 200/302.3
6,956,179 B1 * 10/2005 Gillman et al. ..... 200/302.3

* cited by examiner

*Primary Examiner*—Kyung Lee
*Assistant Examiner*—Richard Lee
(74) *Attorney, Agent, or Firm*—Rosenberg, Klein & Lee

(57) ABSTRACT

A switch includes an actuating member, a cap, and a soft elastic sleeve-shaped member for preventing entrance of water and dust; the actuating member has a base portion, and a second wall projecting upwards from the base portion; the cap has a pressing portion, a first wall projecting downwards from the pressing portion, and a loop-shaped recess abutting the pressing portion on an outer side of the first wall; the cap is joined to the actuating member with the first wall being encompassed by the second wall; the soft elastic member has a pressed portion projecting inwards from an upper end, and a protrusion extending downwards from an inner edge of the pressed portion; the soft elastic member is fixed with the downward protrusion being fitted in the loop-shaped recess, and the pressed portion being tightly pressed between the pressing portion of the cap and the second wall.

1 Claim, 3 Drawing Sheets

WATERPROOF AND DUSTPROOF SWITCH STRUCTURE

BACKGROUND OF THE INVENTION

1. Field of the Invention

The present invention relates to a waterproof and dustproof switch, more particularly one, which is relatively easy to manufacture and assemble, and will emit light through the lateral side thereof.

2. Brief Description of the Prior Art

U.S. Pat. No. 6,573,466B1 discloses a waterproof switch, which comprises:

a housing, a contact system located in the housing, an actuating member arranged in an opening on the housing, said actuating member partly protruding out of the housing and acting on the contact system with a switching effect, and a cap which covers the part of the actuating member protruding out of the housing as well as the opening in the housing and allows the movement of the actuating member, the cap having a cover of a hard material and a sleeve-like part of a flexible material, the sleeve-like part including a bellows, and the cover being arranged on the part of the actuating member protruding out of the opening in such a way that the actuating member is movable via the cover, wherein the cover includes a planar surface for engagement by a user and a rear surface parallel to the planar surface, in that one end of the sleeve-like part is fastened along a peripheral edge on the rear surface, and the other end of the sleeve-like part protrudes beyond the surface of the cover, the protruding other end of the sleeve-like part being arranged on a region of the housing surrounding the opening.

Such waterproof switch structure was found to have disadvantages as followings:

1. In manufacturing and assembly, after the hard cover of the cap is made, it is positioned in a mold for the flexible sleeve-like part of the cap, and a certain kind of adhesive is applied on the hard cover, and injection molding process for the flexible sleeve-like part is started; thus, the cap is made with the flexible sleeve-like part being joined to the hard cover. Therefore, it takes much labor and time to manufacture the cap. Furthermore, because the flexible sleeve-like part and the hard cover are made of different materials, the manufacturers have to take the trouble to find and use a suitable kind of adhesive according to the materials for the flexible sleeve-like part and the hard cover, otherwise the flexible sleeve-like part and the hard cover can't be securely joined together.

2. The sleeve-like part of the cap is impervious to light therefore light can only travel through the top of the switch, and people can only see the top of the switch shining.

SUMMARY OF THE INVENTION

It is a main object of the invention to provide an improvement on a waterproof and dustproof switch, which is easy to manufacture and assemble, and which can emit light through the lateral portion.

The switch of the present invention includes an actuating member, a cap, and a soft elastic sleeve-shaped member for preventing entrance of water and dust. The actuating member has a base portion, and a second wall projecting upwards from the base portion. The cap has a pressing portion, a first wall projecting downwards from the pressing portion, and a loop-shaped recess abutting the pressing portion on an outer side of the first wall. The cap is joined to the actuating member with the first wall being encompassed by the second wall. The sleeve-shaped member has a pressed portion projecting inwards from an upper end, and a protrusion extending downwards from an inner edge of the pressed portion. The sleeve-shaped member is fixed with the downward protrusion being fitted in the loop-shaped recess of the cap, and the pressed portion being tightly pressed between the pressing portion of the cap and the second extension wall.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
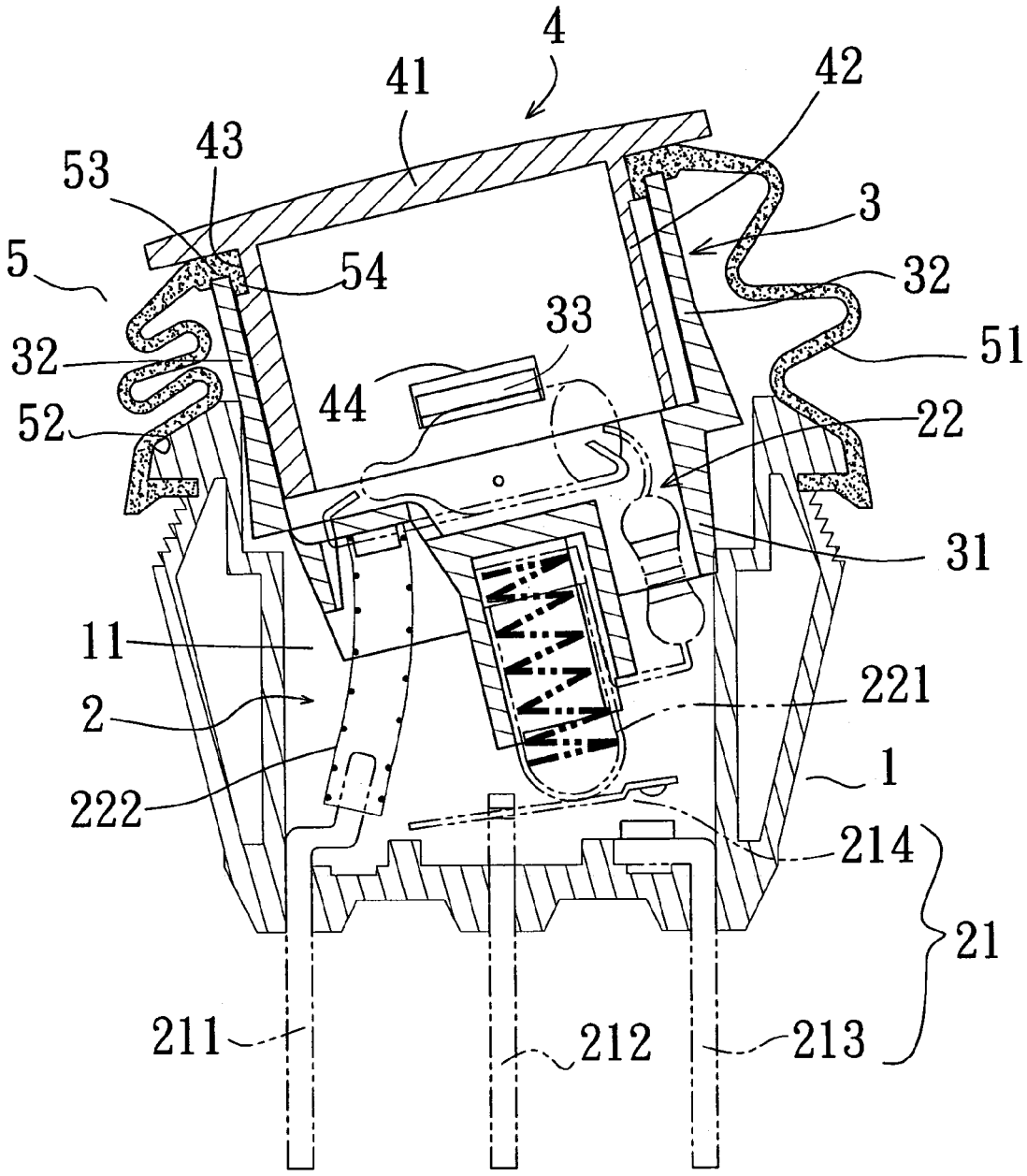
FIG. 1 is a sectional view of the waterproof and dustproof switch in the present invention.
Figure 2:
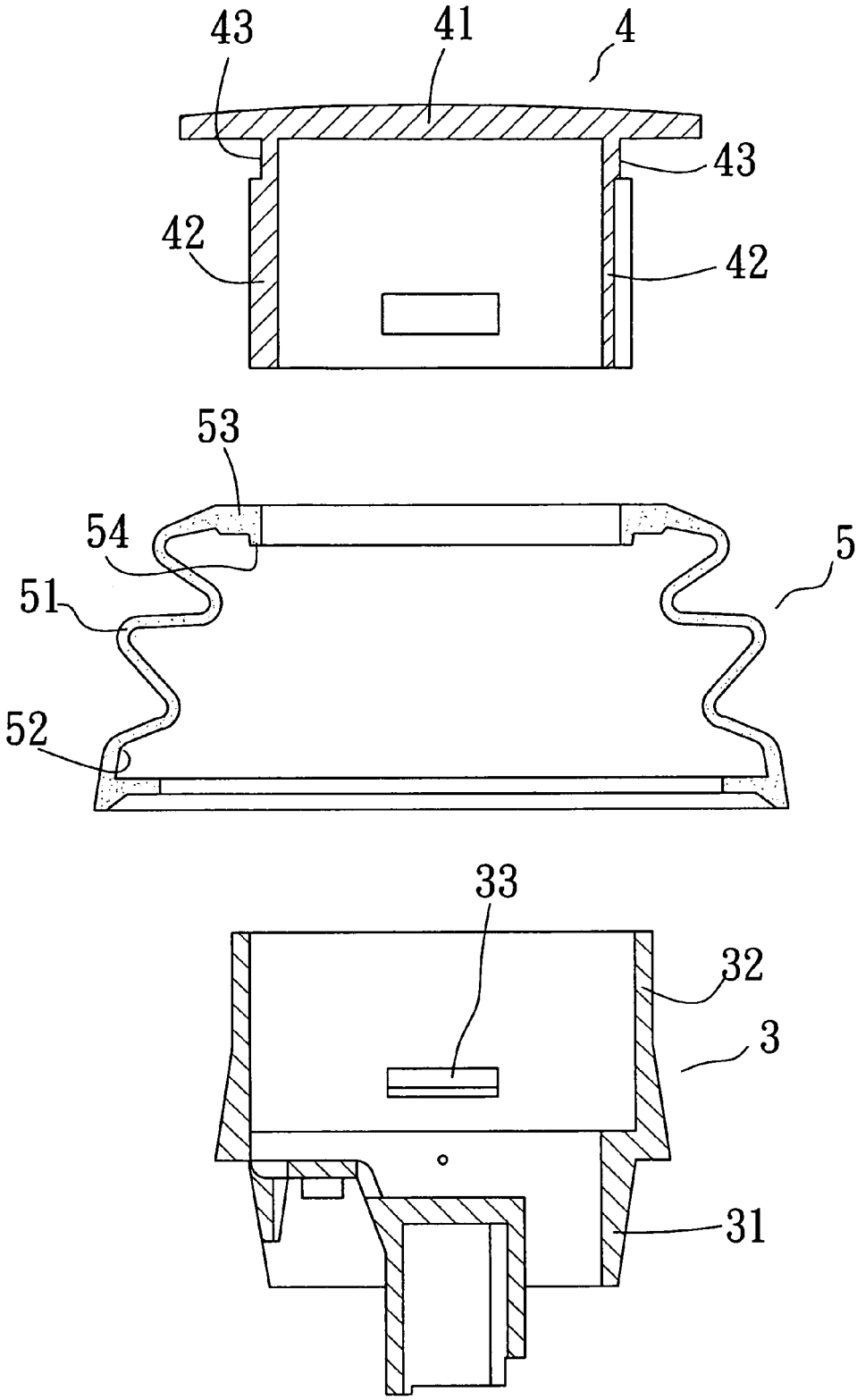
FIG. 2 is a partial exploded perspective view of the switch in the present invention.
Figure 3:
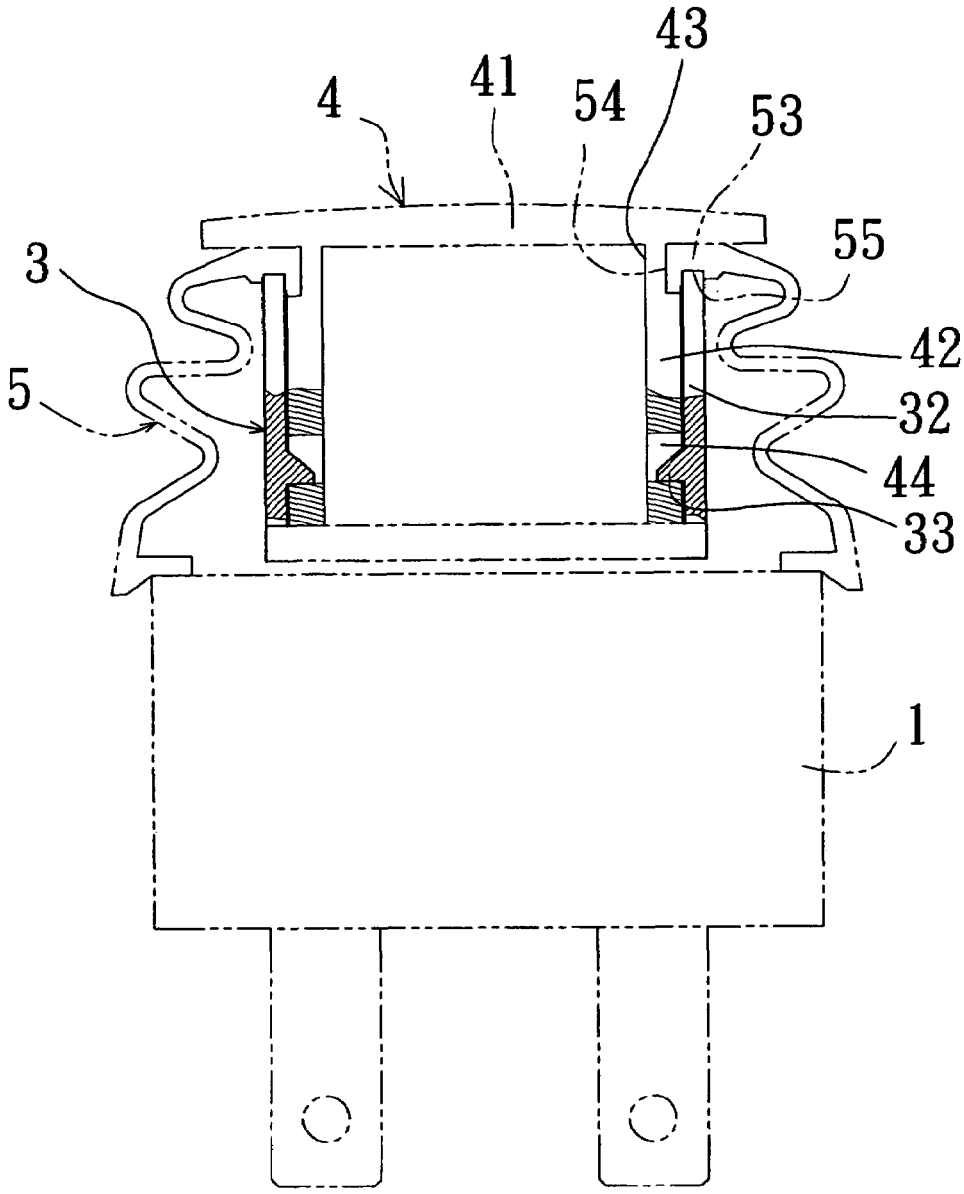
FIG. 3 is a partial sectional view of the switch of the invention.

Referring to FIGS. 1 and 2, a preferred embodiment of a waterproof and dustproof switch of the present invention includes:

a housing 1 having a holding room 11 therein;

a contact device 2 including a terminal set 21, and a shining member 22; the terminal set 21 includes a first terminal 211, a second terminal 212, a third terminal 213, and an electricity conducting plate 214; the first, the second, and the third terminals 211, 213 and 213 are secured to, and stick through a bottom side of the housing 1; the electricity conducting plate 214 is held in the holding room 11 of the housing 1, and pivoted to an inner end of the second terminal 212 with one end facing an inner end of the third terminal 213; the shining member 22 includes first and second contact points 221 and 222;

an actuating member 3 held in, and pivotal to the housing 1; the actuating member 3 has a base portion 31, a second extension wall 32 projecting upwards from an upper end of the base portion 31, and a connecting hook 33 on the second extension wall 32; the shining member 22 is positioned in the base portion 31 of the actuating member 3; the first contact point 221 of the shining member 22 touches the electricity conducting plate 214 so that it will slide on the electricity conducting plate 214 when the actuating member 3 is pressed and pivoted; the second contact point 222 touches the first terminal 211;

a cap 4 joined to the actuating member 3; the cap 4 has a pressing portion 41, a first extension wall 42 projecting downwards from a lower side of the pressing portion 41, a loop-shaped recess 43 on an outer side of the first extension wall 42, which is next to the lower side of the pressing portion 41; the cap 4 has a connecting hole 44 on the first extension wall 42 thereof; the cap 4 is securely joined to the actuating member 3 with the first extension wall 42 being encompassed by the second extension wall 32, and with the connecting hook 33 of the actuating member 3 being passed through the connecting hole 44, and hooked over the first extension wall 42; and a sleeve-shaped waterproof and dustproof member 5 for preventing entrance of water and dust; the waterproof and dustproof member 5 is made of soft elastic and pervious-to-light materials, and has an expandable and compressible portion 51 formed with several folds, a fitting trench 52 on a lower end of an inner side thereof, a pressed portion 53 projecting inwards from an upper end thereof, and a protrusion 54 extending downwards from an inner edge of the pressed portion 53; the waterproof and dustproof member 5 is joined to the housing 1, the actuating member 3, and the cap 4 with an edge of an upper end of the housing 1 being fitted in the fitting trench 52, the protrusion 54 being fitted in the loop-shaped recess 43 of the cap 4, and the pressed portion 53 thereof being tightly pressed between the lower side of the pressing portion 41 of the cap 4 and the upper end of the second extension wall 32 of the actuating member 3; because the waterproof and dustproof member 5 is elastic and soft, a recess 55 will form on the lower side of the pressed portion 53, which touches the upper end of the second extension wall 32, when the pressed portion 53 is tightly pressed between the cap 4 and the upper end of the second extension wall 32.

Therefore, when the shining member 22 is powered, light will travel through the waterproof and dustproof member 5, and people can see the lateral side of the waterproof and dustproof switch of the invention shining.

When comparing the waterproof and dustproof switch of the present invention to the conventional one, it can be seen that the switch of the present invention is easier to manufacture, and it takes less time to assemble the switch because the soft elastic waterproof and dustproof member thereof is securely joined to the actuating member by the above way instead of using adhesive in an injection molding process, and it isn't necessary for the manufacturers to take the trouble to find and use a suitable kind of adhesive according to the materials for the soft elastic waterproof and dustproof member and the actuating member.

What is claimed is:

1. A waterproof and dustproof switch structure, comprising (a) a housing having a holding room therein;

(b) a contact device including a terminal set, and a shining member; the terminal set including:

a first, a second and a third terminals secured to, and sticking through a bottom side of the housing;

an electricity conducting plate held in the holding room of the housing, and pivoted to an inner end of the second terminal with one end facing an inner end of the third terminal;

the shining member including first and second contact points;

(c) an actuating member held in the holding room of the housing; the actuating member having a base portion; the actuating member having a second extension wall projecting upwards from an upper end of the base portion thereof; the actuating member having a connecting hook on the second extension wall thereof; the shining member being positioned in the base portion of the actuating member; the first contact point of the shining member touching the electricity conducting plate of the contact device; the second contact point of the shining member touching the first terminal of the contact device;

(d) a cap; the cap having a pressing portion, and a first extension wall projecting downwards from a lower side of the pressing portion; the cap having a loop-shaped recess on an outer side of the first extension wall, which is next to the lower side of the pressing portion; the cap having a connecting hole on the first extension wall; the cap being securely joined to the actuating member with the first extension wall thereof being encompassed by the second extension wall of the actuating member, and with the connecting hook being passed through the connecting hole, and hooked over the first extension wall; and (e) a sleeve-shaped waterproof and dustproof member for preventing entrance of water and dust; the sleeve-shaped waterproof and dustproof member being made of pervious-to-light and soft elastic materials; the sleeve-shaped waterproof and dustproof member having an expandable and compressible portion formed with a plurality of folds; the sleeve-shaped waterproof and dustproof member having a fitting trench on a lower end of an inner side thereof; the sleeve-shaped waterproof and dustproof member having a pressed portion projecting inwards from an upper end thereof, and a protrusion extending downwards from an inner edge of the pressed portion; an edge of an upper end of the housing being fitted in the fitting trench; the downward protrusion being fitted in the loop-shaped recess of the cap; the pressed portion of the sleeve-shaped waterproof and dustproof member being tightly pressed between the lower side of the pressing portion of the cap and the upper end of the second extension wall of the actuating member.

* * * * *